US011753282B2

(12) United States Patent
Königstein

(10) Patent No.: US 11,753,282 B2
(45) Date of Patent: Sep. 12, 2023

(54) JIB SYSTEM FOR A VEHICLE CRANE COMPRISING A BRACING APPARATUS AND METHOD FOR RIGGING AND DE-RIGGING A BRACING APPARATUS OF A VEHICLE CRANE

(71) Applicant: Tadano Demag GmbH, Zweibrücken (DE)

(72) Inventor: Klaus Königstein, Martinshöhe (DE)

(73) Assignee: TADANO DEMAG GMBH, Zweibrücken (DE)

( * ) Notice: Subject to any disclaimer, the term of this patent is extended or adjusted under 35 U.S.C. 154(b) by 345 days.

(21) Appl. No.: 17/149,263

(22) Filed: Jan. 14, 2021

(65) Prior Publication Data

US 2021/0221658 A1 Jul. 22, 2021

(30) Foreign Application Priority Data

Jan. 17, 2020 (DE) ..... 102020101101.6

(51) Int. Cl.
*B66C 23/82* (2006.01)
*B66C 23/36* (2006.01)

(52) U.S. Cl.
CPC ..... *B66C 23/826* (2013.01); *B66C 23/365* (2013.01)

(58) Field of Classification Search
CPC ..... B66C 23/34; B66C 23/348; B66C 23/64; B66C 23/365; B66C 23/82; B66C 23/821; B66C 23/823; B66C 23/825; B66C 23/826; B66C 23/828
See application file for complete search history.

(56) References Cited

U.S. PATENT DOCUMENTS 7,686,174 B2 * 3/2010 Willim ..... B66C 23/42 212/270
10,640,339 B2 5/2020 Martin et al.
10,640,340 B2 5/2020 Kuhn et al.
10,647,553 B2 5/2020 Martin et al.
10,781,083 B2 9/2020 Kuhn et al.
(Continued)

FOREIGN PATENT DOCUMENTS

DE 19730361 A1 5/1998
DE 102009010452 A1 9/2010
(Continued)

*Primary Examiner* — Sang K Kim
*Assistant Examiner* — Nathaniel L Adams
(74) *Attorney, Agent, or Firm* — Gardner, Linn, Burkhart & Ondersma

(57) ABSTRACT

A jib system for a vehicle crane having a telescopic jib and a bracing apparatus that can be coupled to the jib by its base frame, where the jib has a roller head and a lifting cable that is deflected via the roller head. Only minor structural measures and preparations are required for automatically rigging and de-rigging the vehicle crane, including by providing at least one transfer rocker that can be integrated in an articulated manner between the jib and the bracing apparatus. By the pivotable support of the transfer rocker on the jib, the base frame configured for coupling to the lifting cable can be displaced by a change in the length of the lifting cable that is effected in the coupled state on a circular path around its roller head from a set-down position of the bracing apparatus to a set-up position of the bracing apparatus and back.

19 Claims, 7 Drawing Sheets

(56) References Cited

U.S. PATENT DOCUMENTS

| | | | | |
|---|---|---|---|---|
| 2010/0282700 | A1* | 11/2010 | Richter | B66C 23/344<br>212/177 |
| 2021/0139296 | A1* | 5/2021 | Heintz | B66C 23/826 |
| 2021/0292135 | A1 | 9/2021 | Meissner et al. | |
| 2021/0292136 | A1* | 9/2021 | Meissner | B66C 23/826 |

FOREIGN PATENT DOCUMENTS

| | | | | |
|---|---|---|---|---|
| DE | 102009020338 | A1 | 11/2010 | |
| DE | 102018115632 | B3 | 10/2019 | |
| DE | 102018119316 | A1 | 2/2020 | |
| EP | 1342692 | B1 | 6/2008 | |
| EP | 2248754 | B1 | 6/2014 | |
| WO | WO-2005092775 | A1 * | 10/2005 | B66C 23/828 |

* cited by examiner

JIB SYSTEM FOR A VEHICLE CRANE COMPRISING A BRACING APPARATUS AND METHOD FOR RIGGING AND DE-RIGGING A BRACING APPARATUS OF A VEHICLE CRANE

CROSS REFERENCE TO RELATED APPLICATION

The present application claims the priority benefits of German Application No. DE 10 2020 101 101.6, filed on Jan. 17, 2020.

BACKGROUND AND FIELD OF THE INVENTION

The invention relates to a jib system for a vehicle crane which comprises a telescopic jib and a bracing apparatus which can be coupled to the jib by means of its base frame, wherein the jib has a roller head and a lifting cable which is deflected via the roller head. Furthermore, the invention relates to a correspondingly equipped vehicle crane and to a vehicle crane system comprising such a vehicle crane. The invention also relates to a method for transferring a bracing apparatus from a transport unit onto a jib of a vehicle crane and to a method for transferring a bracing apparatus from a jib of a vehicle crane onto a transport unit.

The factors determining how vehicle cranes or mobile cranes can be used are typically set by the respective structural design thereof. Technical variables such as load-bearing capacity, working radius and lifting height are determined essentially by the design of their mostly telescopic jib. The variables of a vehicle crane can be changed via auxiliary devices such that its load-bearing capacity is increased and/or the elastic sagging of its jib is reduced. An auxiliary device in the form of a bracing device established for this purpose can be e.g. a lateral superlift. By virtue of its arrangement, the lever arm of the jib can be advantageously reduced. The increase in load rendered possible thereby is mostly achieved in combination with additional weights and a corresponding deflection via the bracing device. These vehicle crane systems comprising bracing devices are to be configured in such a manner that the rigging and de-rigging thereof is readily possible on site by means of structural configurations and corresponding measures.

Owing to the already very considerable weight of such vehicle cranes, the cranes often arrive at their respective place of usage only in a partially disassembled manner. This is done in particular in order to respect the maximum values for the axle load and vehicle weight which are set for travelling on public roads. In this context, European patent EP 1 342 692 B1 discloses a vehicle crane system which, in addition to the vehicle crane, comprises a transport unit configured to transport the bracing device. The vehicle crane itself has a telescopic jib having a basic box and linearly displaceable inner boxes. The vehicle crane is designed such that a temporary storage region for the bracing apparatus is provided laterally of the luffed-down jib. On site, the bracing apparatus is raised from the transport unit by means of the jib and is intermediately stored on the storage region of the vehicle crane. Then, the jib is luffed-down to a rigging position such that the bracing apparatus can be secured to a fastening region located on the basic box of the jib.

German laid-open document DE 10 2009 020 338 A1 and European patent EP 2 248 754 B1 disclose a similarly designed vehicle crane system. Specifically, in these cases the bracing apparatus is also brought to the place of usage on a separate transport unit and raised by means of the jib of the vehicle crane. However, the bracing apparatus is then partially supported on the ground and partially supported on a small storage region of the vehicle crane. The support on the ground is effected via a support device which is arranged on the bracing apparatus in such a manner as to be able to be folded out. The free space created by locating the bracing apparatus at a distance from the ground is used in order to arrange the luffed-down jib underneath the bracing apparatus by moving the vehicle crane. Once the bracing apparatus and the jib have been coupled, the vehicle crane system can be used.

The known designs require an intermediate storage of the received bracing apparatus on the ground or on a storage region, formed for this purpose, on the vehicle crane, in order to allow the rigging/de-rigging thereof. In addition, these require a precise orientation of the telescoping jib opposite the direction of travel and in parallel with the longitudinal direction of the vehicle crane in order to be able to receive and store the bracing apparatus to be at least partially supported on the storage region thereof. Particularly in the case of uneven or unstable ground, the at least end-side support of the bracing apparatus thereon can be made difficult. Forming an additional storage region on the vehicle crane likewise gives rise to disadvantages in that the installation space required for this purpose must be kept free and therefore cannot be used for other purposes, or can only be used with difficulty. Typical series production means that consequently such vehicle cranes are then also subjected to possible preparations, although they are not subjected to actual usage by reason of the configuration which has been ordered. Therefore, in addition to increased production costs, the weight and, associated therewith, the operating costs are also increased.

Also, a further method for attaching a bracing apparatus to a telescoping jib of a vehicle crane is described in German patent document DE 10 2018 115 632 B3. The bracing apparatus consists of two bracing arms which are connected to one another at the end via a u-shaped holding frame. In this case, the holding frame can be collapsed from an open receiving position to a fastening position. For attachment purposes, the bracing apparatus is received by a semi-trailer and is placed in the receiving position on the lower carriage of the vehicle crane. Then, the telescoping jib is introduced into the u-shaped holding frame of the bracing apparatus which is then collapsed into its fastening position and is fastened to the telescoping jib.

Furthermore, the subsequently published laid-open document DE 10 2018 119 316 A1 describes a further method for attaching a bracing apparatus to a telescoping jib of a vehicle crane. In this case, the bracing apparatus is based on a semi-trailer and is erected in an oblique manner by a hydraulic cylinder of the semi-trailer. Then, the telescoping jib moves into the bracing apparatus, is pushed by the hydraulic cylinder onto the telescoping jib and is pushed by a further hydraulic tilting apparatus of the semi-trailer further in the direction of an attachment position on the telescoping jib and is fastened to the end at this location.

Furthermore, a method for attaching and detaching a lattice mast extension to/from a telescoping jib of a vehicle crane is already known from German laid-open document DE 10 2009 010 452 A1. For attachment purposes, the assembled lattice mast extension which rests on a ground and the telescoping jib are oriented in a flush manner with respect to one another. Arranged at a foot end of the lattice mast extension is a lattice mast adapter which is pivotable about a horizontal axis and is pivoted upwards by the telescoping jib and is held in this position via a spacer rod. Subsequently, the lattice mast adapter is fastened to a head of the telescoping jib and a lifting cable of the telescoping jib is fastened to a head end of the lattice mast adapter. After removal of the spacer rod, by retracting the lifting cable the lattice mast adapter is folded against the head of the telescoping jib and at the same time the lattice mast extension is raised and likewise folded against the lattice mast adapter. Subsequently, the lattice mast adapter is bolted to the head of the telescoping jib and the lattice mast extension. The detachment procedure is performed in reverse order.

SUMMARY OF THE INVENTION

The present invention provides an improved jib system for a vehicle crane and a correspondingly equipped vehicle crane and a vehicle crane system comprising such a vehicle crane such that for automatically rigging and de-rigging of the vehicle crane only minor structural preparations are required and the required measures can be implemented substantially independently of the orientation of the jib with respect to the rest of the vehicle crane. Two methods are also demonstrated which allow a bracing apparatus to be transferred between the jib of a vehicle crane and a transport unit in a simple manner in only a few steps.

In accordance with an embodiment of the invention, a jib system for a vehicle crane in which at least one transfer rocker is provided that can be integrated in an articulated manner between its jib and the bracing apparatus. The base frame of the bracing apparatus is designed to permit coupling thereof to the lifting cable. By means of the pivotable support of the at least one transfer rocker on the jib, the base frame can be displaced on a circular path around its roller head. As a result, it is possible, by retraction of the lifting cable effected in the coupled state, to displace the base frame from a set-down position of the bracing apparatus, suspended quasi below or in the plane of the jib, to a set-up position of the bracing apparatus lifted up onto the jib, and back.

These vehicle crane systems comprising bracing devices are to be configured such that the rigging and de-rigging thereof is possible via structural configurations and corresponding measures on site, preferably with the aid of additional auxiliary cranes, a rigging frame or a special trailer for the purpose of self-rigging.

The resulting advantage can be seen in the fact that the jib system requires only a few individual configuration features in order to permit the self-rigging thereof. Vehicle cranes which are equipped or can be equipped with the jib system do not require any additional structural configurations in order to support or even place the bracing apparatus e.g. temporarily thereon. In this respect, the jib system in accordance with the invention can be considered to be on the whole universally usable and economically advantageous. In particular, the structural modifications and configurations which are no longer necessary e.g. on the lower carriage and/or superstructure of the vehicle crane allow said vehicle crane to be constructed on the whole in an economically advantageous manner. Moreover, the initial attachment of the bracing apparatus to the jib sometimes allows large tolerances in relation to the orientation of the bracing apparatus relative to the jib. At the same time, its weight is reduced with respect to the otherwise typical configurations, which not only reduces the amount of material used but also makes the operation thereof more economically advantageous on the whole. At the latest after luffing-up the jib, the bracing apparatus becomes oriented relative to the jib automatically or with only small additional measures. As a result, the staff required for rigging and de-rigging can be reduced to a minimum.

In a particular embodiment two transfer rockers that are not necessarily structurally identical can be provided in order to obtain a better weight distribution and more exact guidance of the bracing apparatus during rigging and de-rigging.

According to a further advantageous embodiment of the invention, at least one fastening point can be provided on the roller head or in the region of the roller head. In the case of an arrangement in the region of the roller head, this can be effected e.g. on an inner box of the jib. In an advantageous manner, this can be the particular inner box which carries the roller head of the jib. When two transfer rockers are used, two such fastening points can be provided which can then be arranged e.g. oppositely. In this case, oppositely means that they are each located on one of the two sides of a plane in which the jib extends. In each case, the at least one fastening point is designed to permit a preferably articulated coupling to a first end region of the at least one transfer rocker. Depending upon the configuration, the transfer rocker can thus also be coupled permanently to the associated fastening point.

In accordance with a further embodiment of the invention, at least one connection point can be provided on the base frame of the bracing apparatus. Accordingly, when two transfer rockers are used, two such fastening points can be provided which can then be arranged e.g. oppositely. In this case, oppositely means that they are each located on one of the two sides of a plane in which the jib extends. The at least one fastening point is designed to permit a preferably articulated coupling to a second end region of the at least one transfer rocker. Depending upon the configuration, the transfer rocker can thus also be coupled permanently to the associated connection point.

Furthermore, in a particular aspect of the invention at least one linear drive can be provided which is connected to the roller head via its first end. As a departure from this, it is likewise feasible that the linear drive can be connected to the roller head e.g. only if required. In each case, the at least one transfer rocker can be supported at least indirectly at a second end of the linear drive opposite the first end. Depending upon the configuration, the support can be effected continuously. In relation to the support, it is considered to be advantageous if the transfer rocker is connected in a bending-resistant manner to a lever, via which the support of the transfer rocker can be effected in this respect indirectly.

Alternatively, the at least one transfer rocker extending between its first end region and its second end region opposite the first end region can comprise a linear drive and a lever. In this case, said lever is connected in an articulated manner to the first end region of the transfer rocker. Arranged at its free end portion remote from the first end region of the transfer rocker is an attachment part which is configured for support on the roller head. The linear drive is connected in an articulated manner to the lever via its first end. The connection is located in the region of the free end portion of the lever. Furthermore, the linear drive is connected in an articulated manner to a central portion of the transfer rocker via a second end opposite its first end.

The previously described structure of the at least one transfer rocker or for at least one of two transfer rockers permits controlled pivoting of the transfer rocker equipped in this manner. This is advantageous primarily when it is pivoted about its first end region and it is in this respect free second end region reaches a top dead centre. In this orientation, the transfer rocker can tilt laterally in a substantially unbraked and uncontrolled manner by reason of the gravitational force. In this case, the attachment part arranged on the lever facilitates support of the transfer rocker on the roller head of the jib so as to prevent tilting thereof in at least one direction. The linear drive which extends at least indirectly between the attachment part and the transfer rocker then makes it possible, by reason of its change in length which is then driven e.g. hydraulically, pneumatically or electrically, to obtain a controlled orientation of the transfer rocker in at least one direction. It is also feasible to at least temporarily fix the attachment part to the roller head such that it would also be possible for the transfer rocker to be able to be oriented in a controlled manner in both directions, as stated.

According to a particular embodiment of the invention, at least one tensile element can be provided which is configured for at least temporarily connecting the bracing apparatus to the jib. At least sections of the tensile element can be rigid, elastic or intrinsically movable, such as e.g. in the form of a chain having links. By coupling the bracing apparatus and jib via at least one, preferably four, tensile elements, the bracing apparatus can be oriented with respect to the jib below or in the plane thereof only by reason of the gravitational force, in that it is raised by a corresponding luffing-up of the jib for a corresponding time period. Preferably, the bracing apparatus can comprise two arms which are connected in an articulated manner to its base frame, said arms then having in each case a connecting point which can be connected to the tensile element. It is also feasible for the tensile element to be permanently connected to the connecting point. Of course, as an alternative thereto it is also possible for the base frame of the bracing apparatus to be configured in such a manner that it has corresponding connecting points. It rests with the person skilled in the art to select the more advantageous configuration in each case, for which reason the individual configuration of the respective bracing apparatus will be taken as a basis.

The jib system in accordance with the invention now presented is subjected to only a few structural preparations in order to permit automatic rigging and de-rigging in relation to the bracing apparatus. The movement sequence when setting up and setting down the bracing apparatus can be achieved with existing means which a vehicle crane generally already includes as standard. In particular, the at least initially quasi suspended arrangement of the bracing apparatus on the jib via the at least one transfer rocker and the at least one tensile means or at least two, preferably four, tensile means permits simple and effective orientation of the bracing apparatus relative to the jib such that e.g. complex manoeuvres and/or active displacements can be completely omitted before the bracing apparatus is displaced to its set-up position on the jib. As a result, the required measures, in particular during rigging, are thus reduced to a minimum.

The invention is also directed to a vehicle crane which has a jib system in accordance with the invention, as previously described. The invention is also directed to a vehicle crane system which comprises such a vehicle crane having a jib system and a transport unit formed for transporting the bracing apparatus of the jib system. The resulting advantages in each case have already been explained in greater detail in connection with the inventive jib system and so to avoid repetition reference is made at this juncture to the corresponding statements relating thereto.

Furthermore, the invention is directed to a method which serves to transfer a bracing apparatus from a transport unit, in particular a vehicle crane system, to the jib of a vehicle crane. In a particularly preferred manner, the vehicle crane system can be the vehicle crane system in accordance with the invention. The method comprises the following steps: providing the transport unit having the bracing device received thereon in the region of the vehicle crane such that the bracing apparatus is arranged at least in regions below a front portion of the jib; coupling at least one transfer rocker and at least one tensile element in each case to the bracing apparatus and/or the jib; coupling a lifting cable of the vehicle crane which is deflected on a roller head of the jib to a base frame of the bracing apparatus; commencing displacement of the bracing apparatus attached to the jib from its set-down position in the direction of a set-up position by partially retracting the lifting cable coupled to the base frame such that, in terms of an oscillating movement of the entire bracing apparatus attached to the jib via the tensile element, its base frame which is supported on the jib by means of the at least one transfer rocker is rotated on a circular path around the roller head; further retracting the lifting cable coupled to the base frame until an attachment part of the transfer rocker is supported on the roller head or a linear drive connected to the roller head, thus blocking the base frame from being able to rotate further on the circular path; changing the length of a linear drive which extends at least indirectly between the attachment part and the transfer rocker or the roller head such that an otherwise unbraked further pivot movement of the transfer rocker is then effected during the rotation of the base frame on the circular path on passing beyond its top dead centre in dependence upon the change in the length of the linear drive; further changing the length of the linear drive in parallel with or without further retracting the lifting cable coupled to the base frame until the bracing apparatus is fully placed on the jib, in particular in its set-up position; fixing the base frame of the bracing apparatus to the fastening region of the jib, in particular via at least one releasable connection means; decoupling at least the transfer rocker from the bracing apparatus before, during or after fixing the base frame of the bracing apparatus to the fastening region of the jib.

The above-demonstrated measures of the method in accordance with the invention allow transfer of the bracing apparatus from the transport unit onto the jib of the vehicle crane which can be achieved with the involvement of only a small number of personnel. For this purpose, only a few steps are required which substantially permit automatic rigging of the vehicle crane. In particular, the thus irrelevant orientation of the jib relative to the lower carriage of the vehicle crane offers an extremely advantageous adaptation to the respective local conditions. Accordingly, the jib can be oriented e.g. at a right angle to the longitudinal direction of the lower carriage without the rigging of the vehicle crane being adversely affected as a result.

According to a preferred development of the method in accordance with the invention, the jib can be luffed down if required in the direction of the bracing device received on the transport unit even before it is coupled to the bracing device. As a consequence, the regions of the bracing apparatus and of the jib which are to be connected to one another via the transfer rocker and/or the tensile means are approached accordingly in order to be able to easily carry out the work required for this purpose.

The method in accordance with the invention provides an extremely advantageous measure for automatically orienting the bracing apparatus relative to the jib, in that prior to incorporating the at least one transfer rocker between the bracing apparatus and the jib, the bracing device is coupled to the jib if required via at least two mutually spaced apart tensile elements. In other words, the bracing apparatus is connected to the jib in this case exclusively via at least two, preferably four, tensile elements. By luffing-up the jib, the bracing apparatus is raised at least partially from the transport unit so that it is suspended at least partially unsupported below or in the plane of the jib. At least one of the tensile elements can be arranged for this purpose e.g. around a portion of the jib so that its free end portions can be connected to the bracing apparatus. For this purpose, the jib can have a correspondingly arranged fixing means, on which the tensile element is held to prevent any undesired displacement. In contrast, the tensile element can also be connected directly via one of its end portions to the fixing means. Preferably, a total of four tensile elements can be used in this manner in order to ensure that the bracing apparatus swings in below the jib in the most timely manner possible before it is lifted onto the jib.

Essentially, provision is made that the bracing apparatus can be raised at least partially from the transport unit even before the commencement of its displacement from the set-down position to the set-up position by means of luffing-up the jib. In this manner, the automatic orientation of the bracing apparatus relative to the jib is advantageously assisted.

According to a preferred further development of the method in accordance with the invention, the jib can be telescoped in and/or telescoped out if required before, during or after the displacement of the linear drive. Such an active change in the length of the jib can serve to ensure that its base frame, configured for coupling to the fastening region, of the bracing apparatus is displaced in the designated position relative to the fastening region. In fact, the pivoting-up of the bracing apparatus onto the jib does not compulsorily result in direct alignment of the fastening region of the jib with the base frame of the bracing apparatus such that in this manner an exact orientation of these regions is rendered possible.

The invention is also directed to a method which serves to transfer a bracing apparatus from the jib of a vehicle crane onto a transport unit. Preferably, the vehicle crane can be the vehicle crane in accordance with the invention. The method comprises the following steps: coupling at least one transfer rocker and at least one tensile element in each case to the bracing apparatus and/or the jib; releasing a base frame of the bracing apparatus from a fastening region of the jib before, during or after coupling of the bracing device to the jib; commencing the displacement of the bracing apparatus placed on the jib from its set-up position in the direction of a set-down position by changing the length of a linear drive, which extends at least indirectly between the attachment part and the transfer rocker or the roller head, until the transfer rocker is pivoted beyond its top dead centre; coupling a lifting cable of the vehicle crane deflected at the roller head of the jib to the base frame before, during or after pivoting of the transfer rocker by changing the length of the linear drive; slackening the lifting cable coupled to the base frame, in particular by removing the support of the attachment part of the transfer rocker at the roller head such that, in terms of an oscillating movement of the entire bracing apparatus attached to the jib via the tensile element, its base frame which is supported on the jib by means of the at least one transfer rocker is rotated on a circular path around the roller head; providing the transport unit in the region of the vehicle crane before, during or after the aforementioned measures such that it is arranged at least in regions below the bracing apparatus and/or a front portion of the jib; further slackening the lifting cable coupled to the base frame and/or luffing-down the jib until the bracing apparatus is placed at least partially on the transport unit; decoupling the bracing apparatus from the jib.

According to a preferred development of the method in accordance with the invention, the jib can be luffed down as required before, during or after slackening of the lifting cable coupled to the base frame until the bracing apparatus is placed at least partially on the transport unit. By virtue of this interaction, the bracing apparatus can be placed with precision on the transport unit. Furthermore, in accordance with the invention provision is made that the jib can be telescoped in and/or telescoped out as required before, during or after release of the base frame of the bracing apparatus from the fastening region of the jib. In this manner, enough space can be created in order to displace the base frame freely on the circular path around the roller head. In other words, the roller head can thereby be retracted until collision-free displacement of the base frame is possible.

Basically, the measures of the method in accordance with the invention which have been demonstrated on the whole can be associated at all times with a change in the orientation of the jib relative to the lower carriage of the vehicle crane. This is the case in particular for the positioning of the jib with respect to the transport unit in connection with rigging and/or de-rigging of the vehicle crane.

The advantages achieved by the method in accordance with the invention have incidentally already been discussed or at least analogously discussed in conjunction with the jib system in accordance with the invention and so at this juncture reference is also made on the whole to the previous statements in that regard to avoid repetition.

Aspects of the invention are explained in more detail below with the aid of an exemplified embodiment illustrated in the accompanying figures.

DESCRIPTION OF THE PREFERRED EMBODIMENT

Figure 1:
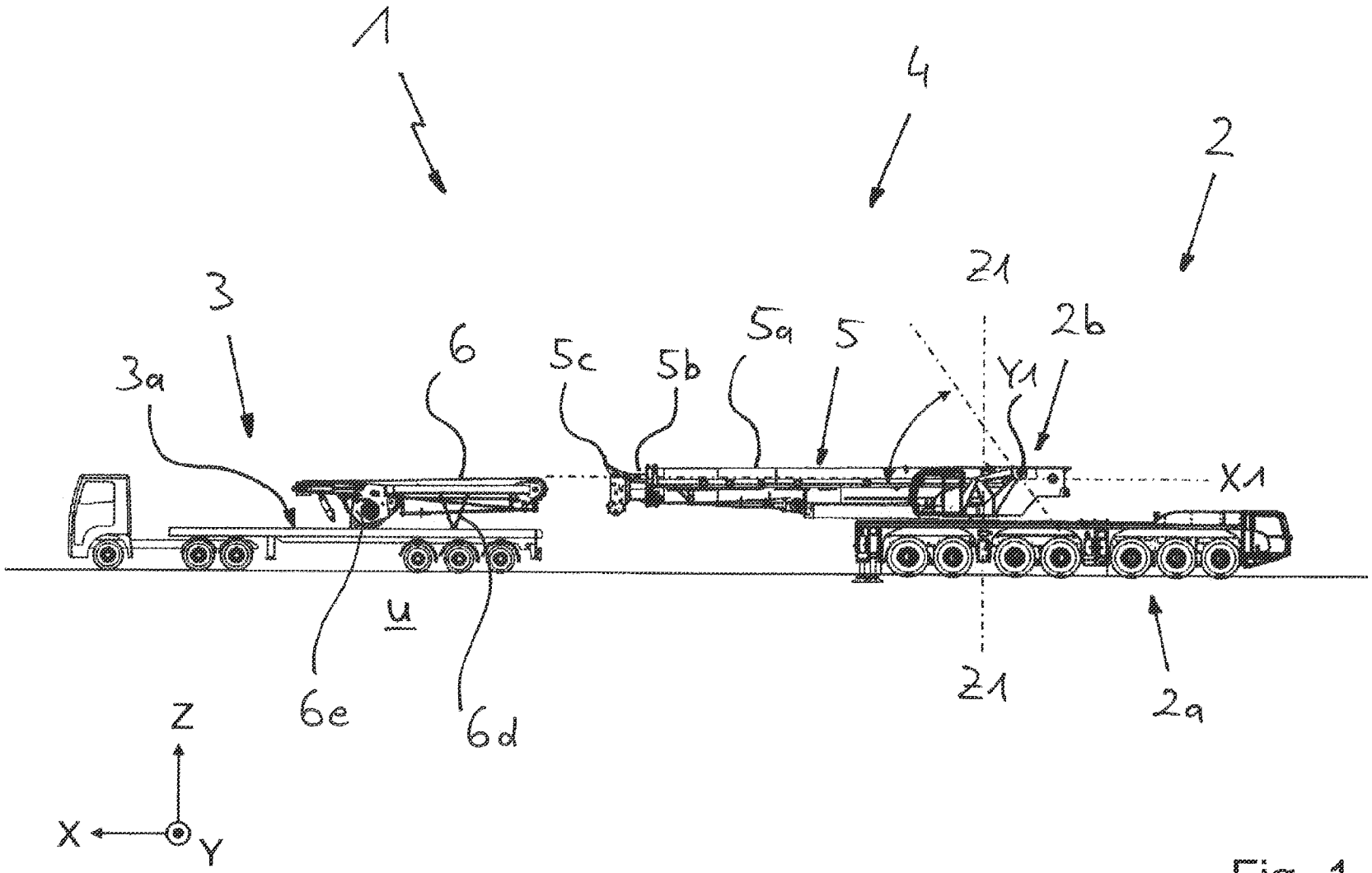
FIG. 1 shows a side view of a vehicle crane system in accordance with the invention consisting of a vehicle crane and a transport unit.

FIG. 1 shows a side view of a vehicle crane system 1 in accordance with the invention which is located on a ground U and which comprises a multi-axle vehicle crane 2 or mobile crane which can be driven on roads, and a transport unit 3. The vehicle crane 2 is equipped with a jib system 4 in accordance with the invention which includes a jib 5, which is arranged on the vehicle crane 2, and a bracing apparatus 6. In the situation shown here relating to a procedure of attaching the bracing apparatus 6 to the jib 5, the bracing apparatus 6 still lies on a storage surface 3*a* of the transport unit 3, by means of which the bracing apparatus 6 has been transported separately from the vehicle crane 1 to the place of usage of the vehicle crane 1. In this case, the transport unit 3 is designed in a known manner as a trailer truck comprising a towing vehicle and a semi-trailer. In a corresponding manner, the storage surface 3*a* for the bracing apparatus 6 lies on the semi-trailer. The vehicle crane 2 typically has a lower carriage 2*a*, on which a superstructure 2*b* carrying the jib 5 is arranged. The superstructure 2*b* can be pivoted relative to the lower carriage 3 about an axis of rotation Z1 which extends in parallel with an upwards direction Z. The jib 5 which extends with its longitudinal axis X1 substantially in parallel with a longitudinal direction X is articulated to the superstructure 2*b* so as to be correspondingly luffable via a horizontal pivot axis Y1 (as indicated by the curved double arrow). In the example shown here, the lower carriage 2*a* has a wheeled running gear unit which has a total of seven axles each having at least two rubber-tyred wheels which are rotatably mounted thereon and are spaced apart from one another in parallel with a vertical direction Y. The jib 5 which in this case is telescoped out only slightly has a basic box 5*a* which is arranged on the superstructure 2*b* and has inner boxes 5*b* which are arranged therein preferably so as to be hydraulically longitudinally displaceable in relation to the longitudinal axis X1 of the jib 5, among the inner boxes the innermost inner box 5*b* carries, at its upper end, a roller head 5*c* and is slightly extended.

It can also be seen in FIG. 1 that the superstructure 2*b* of the vehicle crane 2 is pivoted about approximately 180° rearwards from a position directed forwards for the operation of driving the vehicle crane 2 on roads and therefore the jib 5 protrudes rearwards far beyond the lower carriage 2*a*. In a corresponding manner, it is indicated in FIG. 1 that rear supports of the vehicle crane 2 which are not designated in greater detail by a reference numeral have been extended for the purpose of levelling and stabilising the vehicle crane 2.

Figure 2:
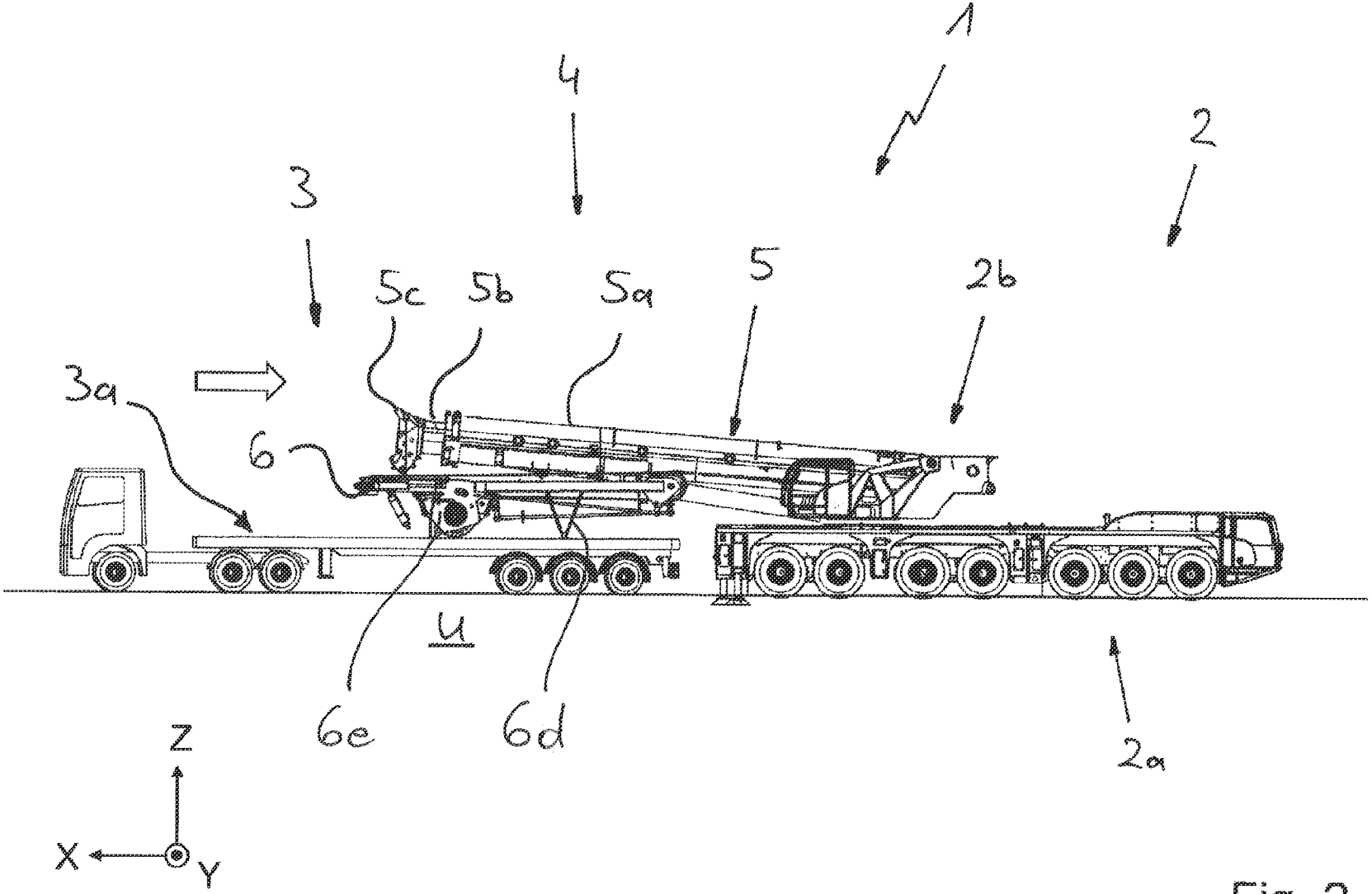
FIG. 2 shows the vehicle crane system of FIG. 1, wherein the transport unit has driven up to the vehicle crane.

FIG. 2 shows the vehicle crane system 1 of FIG. 1 in a position in which the bracing apparatus 6 is transferred from the transport unit 3 by means of the main jib 5, wherein for the upcoming procedure of attaching the bracing apparatus 6 to the main jib 5 the main jib 5 has been luffed up slightly about the pivot axis Y1 and subsequently the transport unit 3 has been driven rearwards towards the rear end of the vehicle crane 2. The driving movement of the transport unit 3 is indicated by a white arrow. The main jib 5 has been luffed up to such an extent that after the transport unit 3 has been driven towards the vehicle crane 2 the roller head 5*c* of the jib 5 is located above the bracing apparatus 6. By reason of the ascending orientation of the jib 5, the basic box 5*a* of the jib 5 is introduced partially and increasingly into the bracing apparatus 6 from above as seen in the longitudinal direction X1 of said jib and in the direction of the superstructure 2*b*. In a corresponding manner, the transport unit 3 is positioned in this transfer position with respect to the vehicle crane 2 such that the bracing apparatus 6 is arranged for the most part below a front portion of the jib 5.

Figure 3:
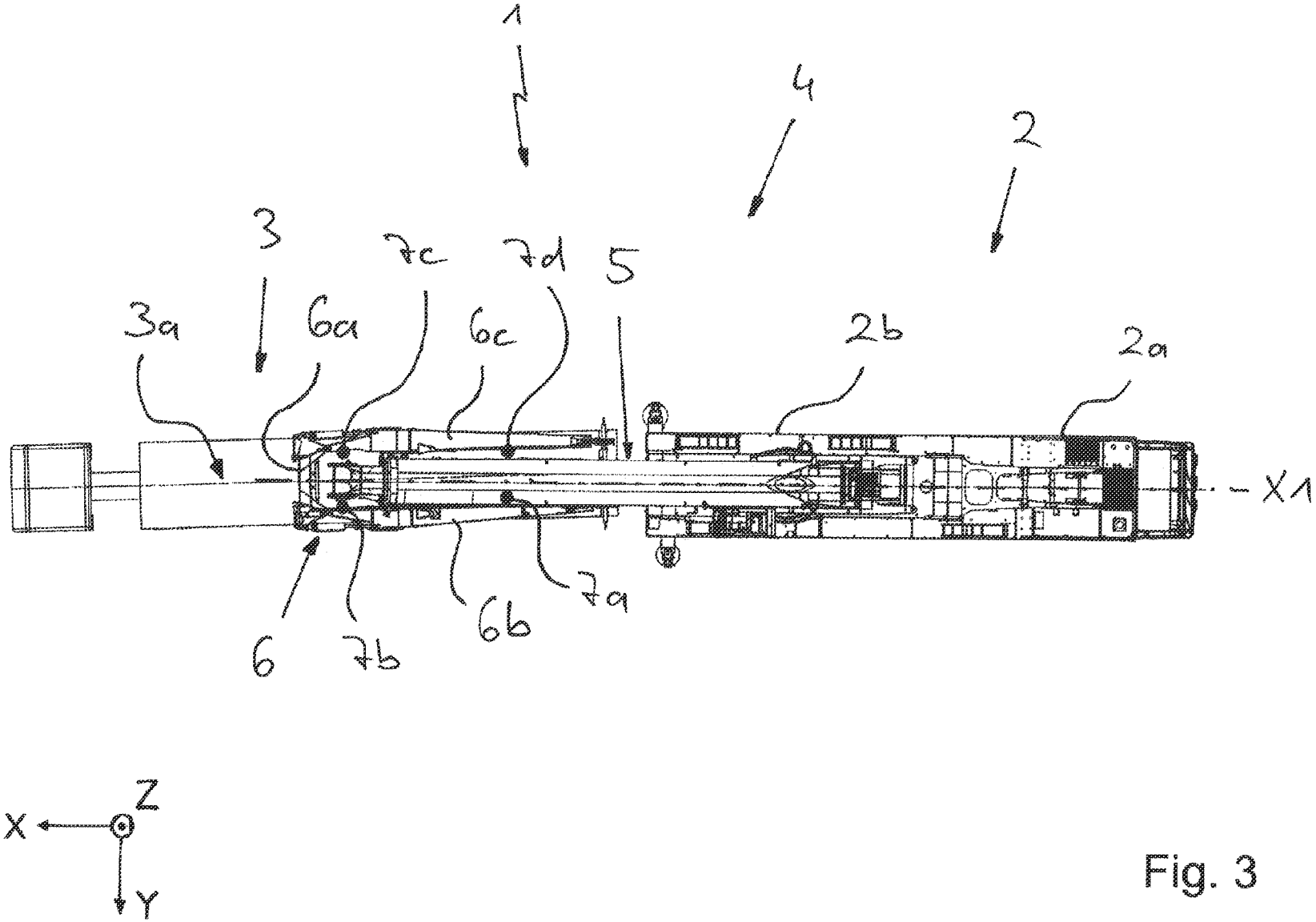
FIG. 3 shows a top view of the vehicle crane system according to FIG. 2.

FIG. 3 shows a top view of the vehicle crane system 1 of FIG. 2. It can be seen that the bracing apparatus 6 is not oriented in an optimum manner with respect to the jib 5. In contrast to FIG. 2, the jib 5 is no longer located between arms 6*b*, 6*c* of the bracing apparatus 6 but instead is already located slightly above the left arm 6*b* of the bracing apparatus 6. Therefore, the jib 5 is luffed up further than is illustrated in FIG. 2, in order to avoid a collision with the arm 6*b*. An optimum orientation would be present if the longitudinal axis X1 of the jib 5 was aligned with a central longitudinal axis, not illustrated in greater detail, of the bracing apparatus 6. However, in the present case there is an angular offset between the longitudinal axis X1 and the longitudinal axis of the bracing apparatus 6. In addition to this angular offset, a lateral offset and/or a vertical offset could also be present or could also additionally be present. These different types of offset which can occur are attributed to the orientation of the transport unit 3 as it drives rearwards towards the vehicle crane 2, the orientation of the bracing apparatus 6 on the storage surface 3*a* of the transport unit 3, and the orientation of the storage surface 3*a* of the transport unit with respect to the vehicle crane 2 by reason of non-horizontal progressions of the ground U. In the transfer position shown in FIG. 3, the bracing apparatus 6 is oriented slightly obliquely with respect to the longitudinal axis X1 of the jib 5; however, the vehicle crane 2 and the transport unit 3 are positioned on an even ground U.

Moreover, FIG. 3 shows the basic structure of the bracing apparatus 6 which has a base frame 6*a* and two arms 6*b*, 6*c* which are connected in an articulated manner to the base frame 6*a*. It can be seen in the top view that the bracing apparatus 6 is thus configured in a substantially U-shaped manner, and the arms 6*b*, 6*c* adjoin the lateral ends of the base frame 6*a*. The base frame 6*a* which connects the two arms 6*b*, 6*c* is located in the transfer position, as seen in the direction of the longitudinal axis X1 of the jib 5, at a sufficient spaced interval in advance of the roller head 5*c* such that, after the bracing apparatus 6 has been oriented with respect to the jib 5, the jib 5 can be introduced between the two arms 6*b*, 6*c* and past the base frame 6*a* into the bracing apparatus 6.

In relation to the orientation of the bracing apparatus 6 with respect to the jib 5, it can be seen in FIG. 3 that the bracing apparatus 6 is oriented obliquely with respect to the jib 5 such that the free end of the arm 6*b* is located below the basic box 5*a* of the trailer 5. In a corresponding manner, the jib 5 must be luffed up in the preceding step until its basic box 5*a* is located completely above the bracing apparatus 6 which at this point in time is still resting on the storage surface 3*a* of the transport unit 3. Only when the bracing apparatus 6 is oriented more effectively with respect to the jib 5, can the jib 5 be luffed up to a lesser extent because the jib 5 can then be moved even partially between the arms 6*b*, 6*c* as the transport unit 3 is driven rearwards towards the vehicle crane 2.

In order to orient the bracing apparatus 6 relative to the jib 5, the bracing apparatus 6 is connected to the jib 5 via a total of four tensile elements 7*a* to 7*d* indicated in this case only by black dots. The tensile elements 7*a* to 7*d* are designed in a typical manner as chains, cables or belts. As seen in the top view, the four tensile elements 7*a* to 7*d* are arranged in the corners of a notional rectangle, the longitudinal extension of which runs in the direction of the longitudinal axis X1. In this case, the tensile elements 7*a*, 7*d* facing the vehicle crane 2 connect the basic box 5*a* in each case to a free end of the arms 6*b*, 6*c* and the tensile elements 7*b*, 7*c* remote from the vehicle crane 2 connect the roller head 5*c* in the region of an upper roller head axis to the end of the arms 6*b*, 6*c* facing the base frame 6*a*. After coupling via the tensile elements 7*a* to 7*d*, the jib 5 is luffed up, whereby the bracing apparatus 6 is raised from the storage surface 3*a* of the transport unit 3 and is thus oriented automatically relative to the jib 5 in a freely suspended manner by utilising the gravitational force. Subsequently, the thus oriented bracing apparatus 6 is then set down on the storage surface 3*a* of the transport unit 3 by luffing the jib 5 down. In this respect, it can be seen in FIG. 2 that the bracing apparatus 6 when in the set-down state rests on the storage surface 3*a* of the transport unit 3 substantially via four points. In this respect, a support 6*d* is arranged in each case in the region of the centre of each arm 6*b*, 6*c* and can be formed in a v-shape or as a vertical post. The fastening winches 6*e* of the bracing apparatus 6 which are arranged in the region of the ends of the arms 6*b*, 6*c* facing the base frame 6*a* and protrude downwards are used as further supports. In the case of other designs of the bracing apparatuses 6, corresponding supports could also be provided instead of the fastening winches 6*e* or could be provided on the fastening winches 6*e*. In conjunction with the setting down of the bracing apparatus 6 on the support surface 3*a* of the transport unit 3 after automatic orientation has been effected, it may be necessary that the length of the supports 6*d* or of corresponding supports on the fastening winches 6*e* has to be adapted in length in order to maintain at least the achieved horizontal orientation of the bracing apparatus 6 with respect to the jib 5. This is necessary particularly if the loading surface 3*a* is not oriented horizontally when the vehicle crane 3 is supported horizontally.

It is obvious that this step of orienting can be omitted if the bracing apparatus 6 is already oriented with respect to the jib 5 on the storage surface 3*a* of the transport unit 3 by merely driving the transport unit 3 towards the vehicle crane 2.

Figure 4:
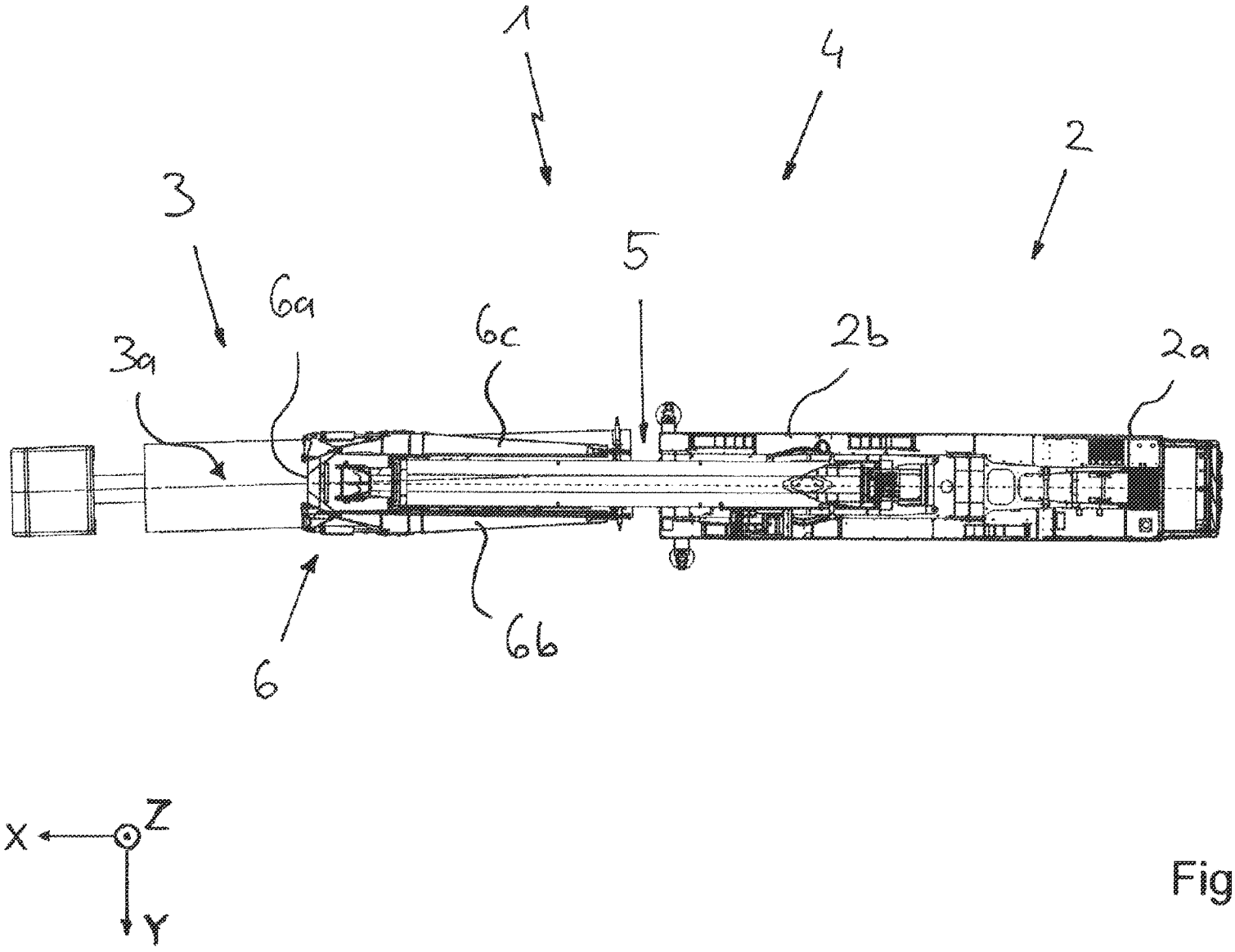
FIG. 4 shows a further top view according to FIG. 3, wherein a bracing apparatus on the transport unit is oriented with a jib of the vehicle crane.

FIG. 4 shows the top view according to FIG. 3 but after the automatic orientation of the bracing apparatus 6 relative to the jib 5 and the setting down of the oriented bracing apparatus 6 on the storage surface 3*a* of the transport unit 3. Subsequently, the tensile elements 7*b*, 7*c* which are located in the region of the base frame 6*a* of the bracing apparatus 6 are removed. The remaining two tensile elements 7*a*, 7*d* in the region of the arms 6*b*, 6*c* remain on the jib 5 and are lengthened or are replaced by other, preferably longer, tensile elements 7*a*, 7*d* which are adapted in terms of their length to the further steps of the attachment procedure. If required, the jib 5 is luffed down further in the direction of the bracing apparatus 6 so that it adopts a position relative to the bracing apparatus 6 which is expedient for the next measures.

Figure 5:
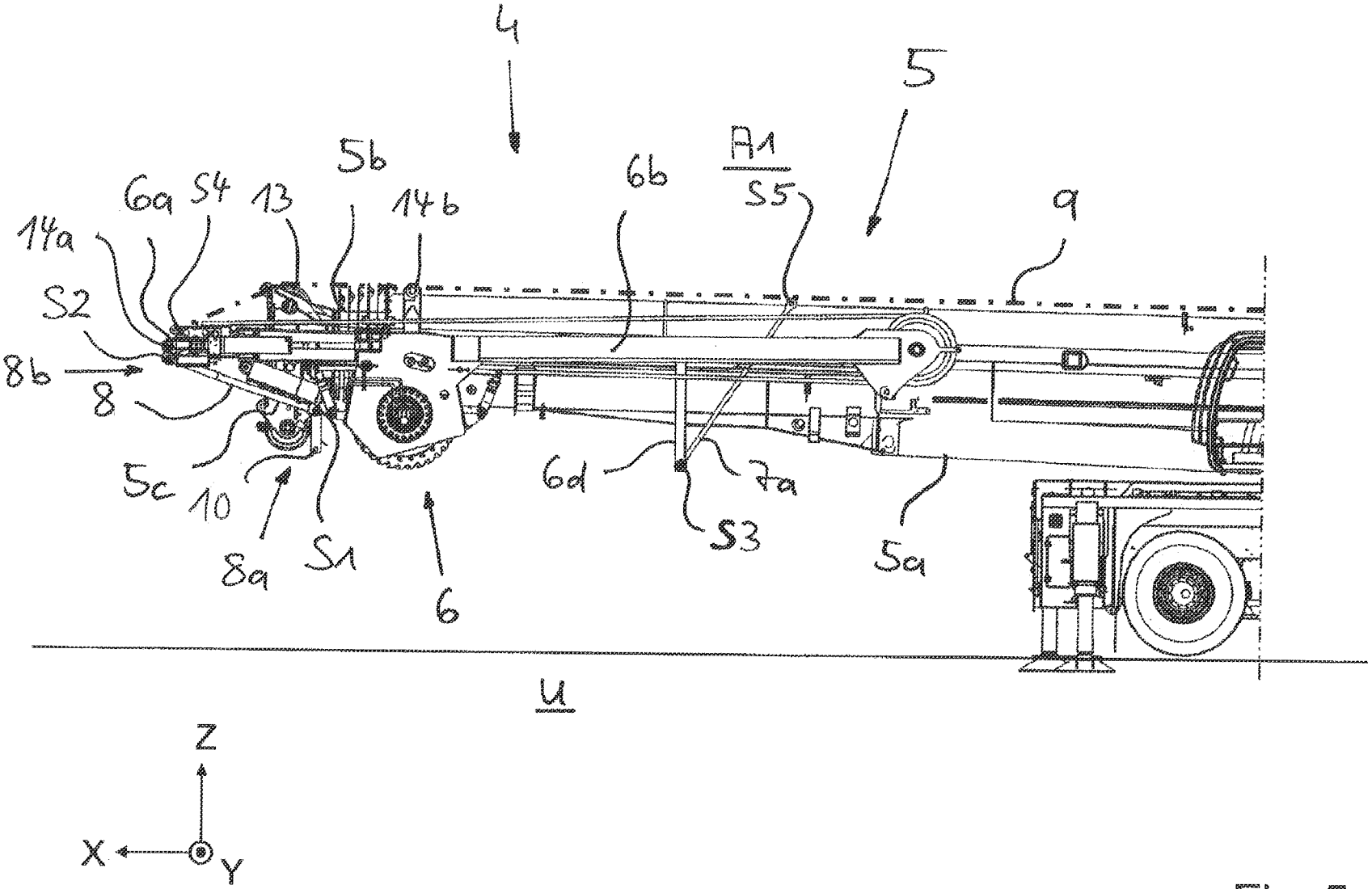
FIG. 5 shows a detail of a side view of the vehicle crane according to FIG. 1 from the region of the jib and the bracing apparatus to be attached in a first position of the bracing apparatus with respect to the jib.

FIG. 5 shows a detail of a side view of the vehicle crane 2 according to FIG. 1 from the region of the jib 5 and the bracing apparatus 6 to be attached in a first position of the bracing apparatus 6 with respect to the jib 5 which is defined as the set-down position A1. In this set-down position A1, the bracing apparatus 6 is already suspended from the jib 5, has previously already been raised slightly from the storage surface 3*a* of the transport unit 3 by the jib 5 and the transport unit 3 has been driven away under the jib 5. The bracing apparatus 6 is suspended from the jib 5 via an illustrated front tensile element 7*a*, a concealed rear tensile element 7*d* in parallel therewith, a front, rod-shaped transfer rocker 8 and a concealed rear transfer rocker in parallel therewith. In addition, a lifting cable 9 is guided along the jib 5 via an upper deflection roller 13 of the roller head 5*c* to the front central end of the base frame 6*a* as seen in the longitudinal axis X1 of the jib 5, and at this location is fastened to the base frame 6*a* at a fourth fastening point S4. The lifting cable 9 is illustrated only symbolically by a dot and dash line. Therefore, the bracing apparatus 6 is suspended from the jib 5 at five points in total.

In order to achieve this state, in addition to the lifting cable 9, prior to lifting the bracing apparatus 6 from the transport unit 3, the tensile elements 7*a*, 7*d* are each fastened in an articulated manner with their lower end to the lower end of the respective support 6*d* at a third fastening point S3 and are fastened in an articulated manner with their upper end at the top laterally to the basic box 5*a* of the jib 5 at a fifth fastening point S5. At this location, the tensile elements 7*a*, 7*d* are also already fastened when the bracing apparatus 6 is automatically oriented with respect to the jib 5. Also, a transfer rocker 8 is fastened in each case with its lower first end region 8*a* at a first fastening point S1 in the lower region of the roller head 5*c* and is fastened with its opposite upper second end region 8*b* at the front and laterally to the base frame 6*a* at a second fastening point S2. From the arrangement of the fifth fastening point S5 with respect to the third fastening point S3 and of the second fastening point S2 with respect to the first fastening point S1, it is apparent that the bracing apparatus 6 is not freely suspended from the jib 5 but instead is already pivoted to the left on a circular path via the lifting cable 9 and therefore is located outside possible dead centres in relation to the pivoting drive or attachment drive via the lifting cable 9. In a corresponding manner, the tensile elements 7*a*, 7*d* and the deflection rockers 8 are pivoted, in relation to a vertical, to the left about the fifth fastening point S5 or the second fastening point S2.

The fastening of the tensile elements 7*a*, 7*d* and the two transfer rockers 8 to the jib 5 or the bracing apparatus 6 is configured in each case to be pivotable at least about an axis which is horizontal and is oriented transversely with respect to the longitudinal axis X1 of the trailer 5. As seen in the top view according to FIG. 4, the tensile elements 7*a*, 7*d* and the two transfer rockers 8 extend in a lateral intermediate space between the jib 5 or its basic box 5*a* or roller head 5*c* and an inner side of the arms 6*b*, 6*c*. Moreover, provision is made that the transfer rockers 8 are oriented in relation to the driving lifting cable 9 outside their dead centre and forwards as seen in the direction of the longitudinal axis X1. The same applies to the tensile elements 7*a*, 7*d* in order thus to achieve defined movement kinematics of the bracing apparatus 6 with respect to the jib 5.

The tensioned lifting cable 9 and the tensile elements 7*a*, 7*d* which are tensile-loaded thereby and the two compression-loaded transfer rockers 8 ensure that the bracing apparatus 6 remains in the set-down position A1 illustrated in FIG. 5 even if the bracing apparatus 6 is raised from the storage surface 3*a* of the transport unit 3 by means of luffing the jib 5.

Figure 6:
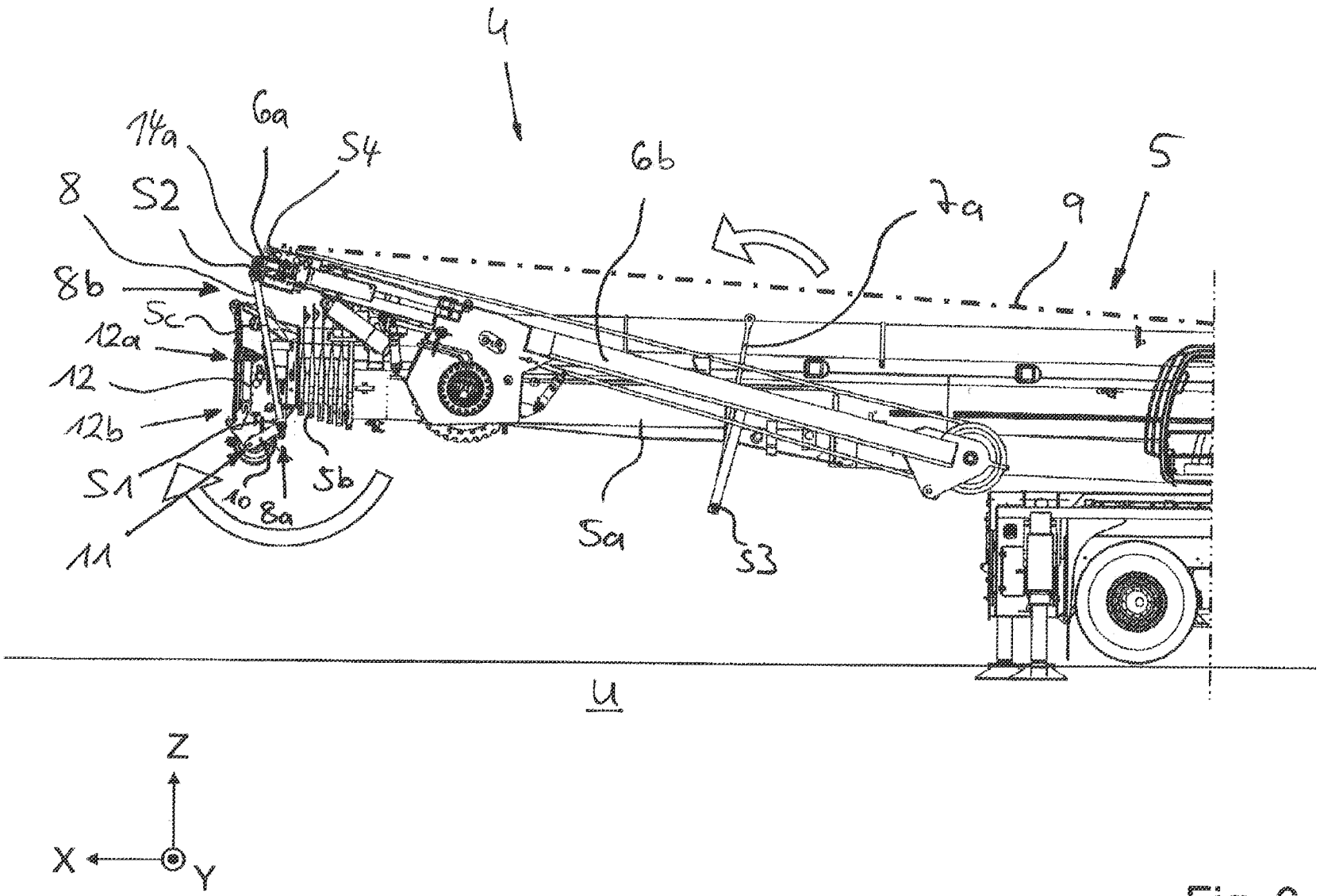
FIG. 6 shows the detail according to FIG. 5 in a second position of the bracing apparatus with respect to the jib.

FIG. 6 shows the commencement of the displacement of the bracing apparatus 6 from its set-down position A1 in the direction of a set-up position A2 on the upper side of the jib 5. For this purpose, winding of the lifting cable 9 causes a corresponding tensile force to be applied to the bracing apparatus 6 such that the base frame 6*a* which is coupled to the lifting cable 9 and is supported by means of the two transfer rockers 8 on the jib 5 is rotated upwards around the roller head 5*c* on a circular path at a spaced interval and without any collisions (as indicated by the white arrow curved in the clockwise direction). The radius of said circular path is defined by the length of the transfer rockers 8 extending between the fastening points S1, S2. In this case, the bracing apparatus 6 which at the same time is attached to the jib 5 via the tensile elements 7*a*, 7*d* is displaced in terms of an oscillating movement relative to the jib 5 in the direction of the vehicle crane 2, which is composed of a rotational and at the same time translational movement sequence in which the bracing apparatus 6 is supported on the pivoting tensile elements 7*a*, 7*d* (as indicated by the white arrow curved in the anticlockwise direction). Since the height of the fourth fastening point S4 of the lifting cable 9 at the base frame 6A exceeds the height of the deflection roller 13 at the roller head 5*c*, the guidance via the deflection roller 13 is abandoned or is no longer required.

In order to avoid a situation where, after passing beyond a vertical orientation of the transfer rocker 8 in terms of a top dead centre and further tensile movement of the lifting cable 9, the bracing apparatus 6 comes to lie with its base frame 6*a* in an uncontrolled manner on the upper side of the basic box 5*a*, the tensile force of the lifting cable 9 is to be advantageously subjected to a counter force which acts upon the transfer rockers 8 and is less than the tensile force of the lifting cable 9. This counter force can be provided in the form of a spring or a hydraulic cylinder. The hydraulic cylinder has the advantage that it can also be used during the course of detaching the bracing apparatus 6 from the jib 5 in order to reach and pass beyond the aforementioned top dead centre in the opposite direction.

In the embodiment variant shown here purely by way of example, the transfer rocker 8, in the region of the first fastening point S1, is additionally connected in a bending-resistant manner to a lever 10 and is thus configured as an angle lever. An attachment part 11 is arranged at a free end of the lever 10. Furthermore, a linear drive 12 is laterally connected to the roller head 5*c* via its first end 12*a* and is oriented vertically when the jib 5 extends horizontally. Before or upon reaching a top dead centre of the second end region 8*b* of the transfer rocker 8—in this case approximately a vertical—the attachment part 11 of the lever 10 is supported on a second end 12*b* of the linear drive 12 opposite the first end 12*a*. At this moment, the ability of the base frame 6*a* to rotate further on the circular path around the roller head 5*c* is initially blocked and is dependent upon a change in the length of the linear drive 12.

Figure 7:
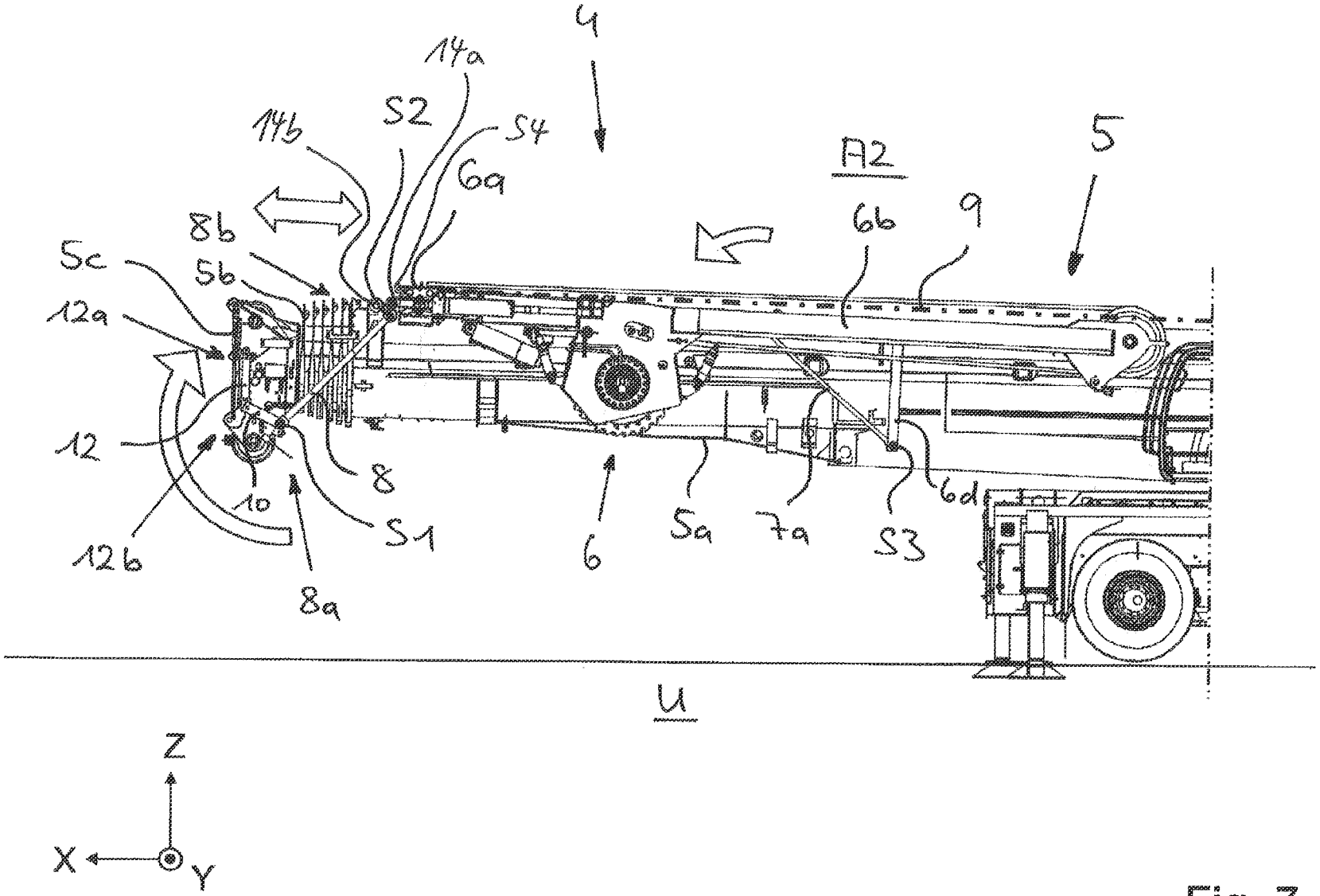
FIG. 7 shows the detail according to FIG. 5 in a third position of the bracing apparatus with respect to the jib.

FIG. 7 shows a further detail according to FIG. 5 in a third position of the bracing apparatus 6 with respect to the jib 5. In this third position, the base frame 6*a* of the bracing apparatus 6 is placed on the basic box 5*a* of the jib 5 and the bracing apparatus 6 has reached its set-up position A2 on the jib 5. For this purpose, the further rotation of the base frame 6*a* on the circular path about the roller head 5*c* was effected in that the linear drive 12 was retracted against the cable force of the lifting cable 9. The second end region 8*b* of the transfer rocker 8 which is loaded by means of the weight of the bracing apparatus 6 has thereby been lowered slowly towards the jib 5, wherein its first end region 8*a* has been continuously damped or braked in a controlled manner with respect to a free rotation about the fastening pint S1 at the roller head 5*c* via the lever 10 supported on the linear drive 12. Depending upon the configuration or procedure, a further retraction of the lifting cable 9 can be effected or omitted during this movement. Without the lifting cable 9, the attachment part 11 must be bolted beforehand to the second end 12*b* of the linear drive 12.

Finally, the bracing apparatus 6, in particular its base frame 6*a*, is then still to be fastened to the basic box 5*a*. This is typically effected by bolting a first connection plate 14*a* to the basic box 5*a* and a second connection plate 14*b* to the base frame 6*a*. Solely by reaching the set-up position A2, the base frame 6*a* is oriented with its connection plates 14*a*, of which only a front one is shown in FIG. 7 since the rear one in parallel therewith is concealed thereby, if necessary in the height direction with respect to the second connection plates 14*b* on the base frame 6*a*. The spaced interval between the first and second connection plates 14*a*, 14*b* which form a fastening region if the bracing apparatus 6 is located in the set-up position A2 can be adjusted over the length of the transfer rockers 8. In the present exemplified embodiment, the length of the transfer rockers 8 is selected to be slightly longer so that the first connection plates 14*a* are oriented as seen in the longitudinal axis X1 with respect to the second connection plates 14*b* in a slightly offset manner with respect to the superstructure 3. Basically, the length of the transfer rockers 8 can also be selected such that the two connection plates 14*a*, 14*b* are already aligned with one another when the set-up position A2 is reached. In the present case, the base frame 6*a* of the bracing apparatus 6 which is connected to the roller head 5*c* via the transfer rockers 8 will be displaced with its first connection plates 14*a* into the aligned position relative to the second connection plates 14*b* of the jib 5, in that the innermost inner box 5*b* with the roller head 5*c* is telescoped out accordingly. If, as a result, the first and second connection plates 14*a*, 14*b* of the fastening region are aligned with one another, the base frame 6*a* is fixed to the jib 5 via fastening means which are not shown in greater detail here. Subsequently, rigging cylinders 15 arranged in each case on the arms 6*b*, 6*c* in proximity to the base frame 6*a* are pivoted from a parking position to an operating position and are fastened to the lower sides of the basic box 5*a* at corresponding bearing points. By actuating the rigging cylinders 15, the arms 6*b*, 6*c* can be pivoted slightly upwards and therefore the tensile elements 7*a*, 7*d* can be relieved and removed. Then, the transfer rockers 8 are decoupled from the bracing apparatus 6 or its base frame 6*a* in order to permit the telescoping capability of the jib 5. The transfer rockers 8 remain on the roller head 5*c* in a parking position. Accordingly, the lifting cable is released from the fourth fastening point S4 and reeved at the roller head 5*c* for the normal crane operation of the vehicle crane 2.

In an alternative embodiment of the transfer rocker 8, provision is made to form the lever 10 not in a bending-resistant manner but instead to form said lever like the transfer rocker 8 in such a manner as to be pivotable about the first fastening point S1. Furthermore, the linear drive 12 is then connected via its first end 12*a* in an articulated manner to the lever 10 at the free end portion 10*a* thereof. The second end 12*b* of the linear drive 12 is connected in an articulated manner to a central portion 8*c* of the transfer rocker 8. In the case of this alternative, the lever 10 also pivots with its attachment part 11 during retraction of the lifting cable 9, which is coupled to the base frame 6*a*, as far as a stop on the roller head 5*c*. From this point in time, the otherwise unbraked further pivot movement of the transfer rocker 8, as it passes beyond its top dead centre, is likewise effected in dependence upon the change in the length of the linear drive 12 as also in the previously demonstrated variant.

The transfer of the bracing apparatus 6 from the jib 5 of the vehicle crane 2 onto the transfer unit 3, which extends quasi in the opposite direction, is effected in a correspondingly expedient reverse order of the individual measures, as already explained in greater detail in the description. In both variants, the displacement of the bracing apparatus 6 placed on the jib 5 from its set-up position A2 in the direction of the set-down position A1 commences by reducing the length of the linear drive 12 which is supported indirectly on the roller head 5*c* of the jib 5 via the contact part 11. In contrast, said transfer in the previously demonstrated embodiment variant is effected by increasing or reducing the length of the linear drive 12 connected to the roller head 5*c*. In both cases, the transfer rocker 8 is pivoted until its second end region 8*b* reaches the top dead centre. The movement sequence beyond this is based upon the slackening of the lifting cable 9 coupled to the base frame 6*a* of the bracing apparatus 6.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A jib system of a vehicle crane, said jib system comprising:

a telescopic jib having a roller head and a lifting cable that is deflected via the roller head; and a bracing apparatus having a base frame, wherein the bracing apparatus is configured to be coupled to the jib by the base frame with the base frame configured for coupling to the lifting cable;

wherein at least one transfer rocker is provided between the jib and the bracing apparatus in an articulated manner, wherein at least one tensile element is provided that is configured for at least temporarily connecting the bracing apparatus to the jib, wherein the bracing apparatus comprises two arms that are connected in an articulated manner to the base frame and that each have a connecting point that can be connected or is connected to the tensile element, and wherein via a pivotable support of the at least one transfer rocker on the jib the base frame can be displaced when the base frame is in a coupled state with the lifting cable by a change in the length of the lifting cable on a circular path around the roller head from a set-down position of the bracing apparatus to a set-up position of the bracing apparatus and back, wherein in the set-down position the bracing apparatus is suspended from the jib via the tensile elements and the transfer rocker.

2. The jib system as claimed in claim 1, wherein on the roller head or in the region of the roller head at least one first fastening point is provided that can be coupled or is coupled to a first end region of the at least one transfer rocker.

3. The jib system as claimed in claim 2, wherein the at least one first fastening point comprises two opposite first fastening points that can be coupled or are coupled to the first end region of the at least one transfer rocker.

4. The jib system as claimed in claim 1, wherein on the base frame of the bracing apparatus at least one second fastening point is provided that can be coupled or is coupled to a second end region of the transfer rocker.

5. The jib system as claimed in claim 4, wherein the at least one second fastening point comprises two fastening points that can be coupled or are coupled to the second end region of the transfer rocker.

6. The jib system as claimed in claim 1, wherein at least one linear drive having a first end and a second end is provided that is connected or is connectable to the roller head via the first end, wherein the at least one transfer rocker is supported or is supportable at least indirectly on the second end of the linear drive opposite the first end.

7. The jib system as claimed in claim 6, wherein the at least one transfer rocker is supported or is supportable via a lever connected thereto in a bending-resistant manner.

8. The jib system as claimed in claim 1, wherein the at least one transfer rocker extends between a first end region and a second end region of the at least one transfer rocker and comprises a linear drive having a first end and a second end and further comprises a lever that is connected in an articulated manner to the first end region of the at least one transfer rocker, wherein the lever includes a free end portion remote from the first end region of the transfer rocker, and wherein at the free end portion an attachment part is arranged that is configured for support on the roller head, and wherein the linear drive is connected in an articulated manner via the first end to the lever in the region of the free end portion and is connected in an articulated manner via the second end opposite the first end to a central portion of the transfer rocker.

9. The jib system of claim 1, wherein the jib system is equipped on a vehicle crane, and further comprising a transport unit configured to transport the bracing apparatus of the jib system, and wherein the jib system, the vehicle crane and the transport unit comprise a vehicle crane system.

10. The jib system of claim 1, wherein the jib system is equipped on a vehicle crane.

11. A method for transferring a bracing apparatus from a transport unit onto a jib of a vehicle crane having a jib system, comprising the steps of:

providing the transport unit having the bracing apparatus received thereon in the region of the vehicle crane such that the bracing apparatus is arranged at least in regions below a front portion of the jib;

coupling at least one transfer rocker to the bracing apparatus and the jib and coupling at least one tensile element to the bracing apparatus and the jib;

coupling a lifting cable of the vehicle crane that is deflected on a roller head of the jib to a base frame of the bracing apparatus;

displacing the bracing apparatus attached to the jib from a set-down position in the direction of a set-up position by retracting the lifting cable coupled to the base frame such that, in terms of an oscillating movement of the entire bracing apparatus attached to the jib via the tensile element, the base frame that is supported on the jib by the at least one transfer rocker is rotated on a circular path around the roller head;

further retracting the lifting cable coupled to the base frame until an attachment part of the transfer rocker is supported on the roller head or a linear drive connected to the roller head, thus blocking the base frame from being able to rotate further on the circular path;

changing the length of the linear drive that extends at least indirectly between the attachment part and the transfer rocker or the roller head such that an otherwise unbraked further pivot movement of the transfer rocker is then effected during the rotation of the base frame on the circular path on passing beyond a top dead center of the transfer rocker in dependence upon the change in the length of the linear drive;

further changing the length of the linear drive in parallel with or without further retracting the lifting cable coupled to the base frame until the base frame of the bracing apparatus is fully placed on the jib;

fixing the base frame of the bracing apparatus to a fastening region of the jib; and decoupling at least the transfer rocker from the bracing apparatus before, during or after fixing the base frame of the bracing apparatus to the fastening region of the jib.

12. The method as claimed in claim 11, wherein said further changing the length of the linear drive comprises further changing the length of the linear drive until the base frame of the bracing apparatus is placed on the jib in the set-up position.

13. The method as claimed in claim 11, wherein said fixing the base frame of the bracing apparatus to a fastening region of the jib comprises fixing the base frame of the bracing apparatus to a fastening region of the jib via at least one releasable connection.

14. The method as claimed in claim 11, wherein prior to coupling the jib to the bracing device, the jib is luffed down if required in the direction of the bracing device received on the transport unit.

15. The method as claimed in claim 11, wherein prior to integrating the at least one transfer rocker between the bracing apparatus and the jib, the bracing apparatus is coupled to the jib if required via at least two mutually spaced apart tensile elements, and wherein the bracing apparatus is oriented relative to the jib via at least partially raising the bracing apparatus from the transport unit by luffing up the jib.

16. The method as claimed in claim 11, wherein the bracing apparatus, prior to commencing a displacement of the bracing apparatus from the set-down position to the set-up position, is raised at least partially from the transport unit by luffing-up the jib.

17. The method as claimed in claim 11, further comprising telescoping the jib in and/or telescoping the jib out, if required, before, during or after the displacement of the linear drive until the base frame of the bracing apparatus configured for coupling to the fastening region of the jib is located in the designated position relative to the fastening region.

18. A method for transferring a bracing apparatus from a jib of a vehicle crane comprising a jib system onto a transport unit in a vehicle crane system, comprising the steps of:

coupling at least one transfer rocker to the bracing apparatus and/or the jib and coupling at least one tensile element to the bracing apparatus and/or the jib;

releasing a base frame of the bracing apparatus from a fastening region of the jib before, during or after coupling of the bracing device to the jib;

commencing a displacement of the bracing apparatus placed on the jib from a set-up position in the direction of a set-down position by changing the length of a linear drive that extends at least indirectly between an attachment part and the transfer rocker or a roller head, until the transfer rocker is pivoted beyond a top dead center of the transfer rocker;

coupling a lifting cable of the vehicle crane deflected at the roller head of the jib to the base frame before, during or after pivoting of the transfer rocker by changing the length of the linear drive;

slackening the lifting cable coupled to the base frame by removing a support of the attachment part of the transfer rocker at the roller head such that, in terms of an oscillating movement of the entire bracing apparatus attached to the jib via the tensile element, the base frame that is supported on the jib by the at least one transfer rocker is rotated on a circular path around the roller head;

providing the transport unit in the region of the vehicle crane before, during or after the aforementioned measures such that it is arranged at least in regions below the bracing apparatus and/or a front portion of the jib;

further slackening the lifting cable coupled to the base frame and/or luffing-down the jib until the bracing apparatus is placed at least partially on the transport unit; and decoupling the bracing apparatus from the jib.

19. The method as claimed in claim 18, wherein the jib is luffed down if required before, during or after slackening of the lifting cable coupled to the base frame until the bracing apparatus is placed at least partially on the transport unit.

* * * * *